United States Patent [19]

Wessel

[11] 4,390,488

[45] Jun. 28, 1983

[54] PRESSING METAL POWDER INTO SHAPES

[75] Inventor: Otto Wessel, Duisburg, Fed. Rep. of Germany

[73] Assignee: Mannesmann Aktiengesellschaft, Düsseldorf, Fed. Rep. of Germany

[21] Appl. No.: 947,099

[22] Filed: Sep. 29, 1978

[30] Foreign Application Priority Data

Oct. 4, 1977 [DE] Fed. Rep. of Germany ..... 2745020

[51] Int. Cl.[3] ..... D04H 1/20

[52] U.S. Cl. ..... 419/66; 264/112; 264/113; 264/120

[58] Field of Search ..... 264/111, 112, 113, 120

[56] References Cited

U.S. PATENT DOCUMENTS

| | | | |
|---|---|---|---|
| 4,077,109 | 3/1978 | Larson | 264/111 |
| 4,135,286 | 1/1979 | Wright et al. | 264/111 |
| 4,170,619 | 10/1979 | Fridrich | 264/113 |

*Primary Examiner*—James R. Hall

*Attorney, Agent, or Firm*—Ralf H. Siegemund

[57] ABSTRACT

An annular die and a matingly provided annular punch cooperate for stepwise building-up a hollow; the punch has one or two channels to which powder is fed; the amount for each feed is limited so that the height of the powder compressed in each step is about 0.6 to 0.8 times the annular dimension of the product to be made.

3 Claims, 4 Drawing Figures

(B-B)

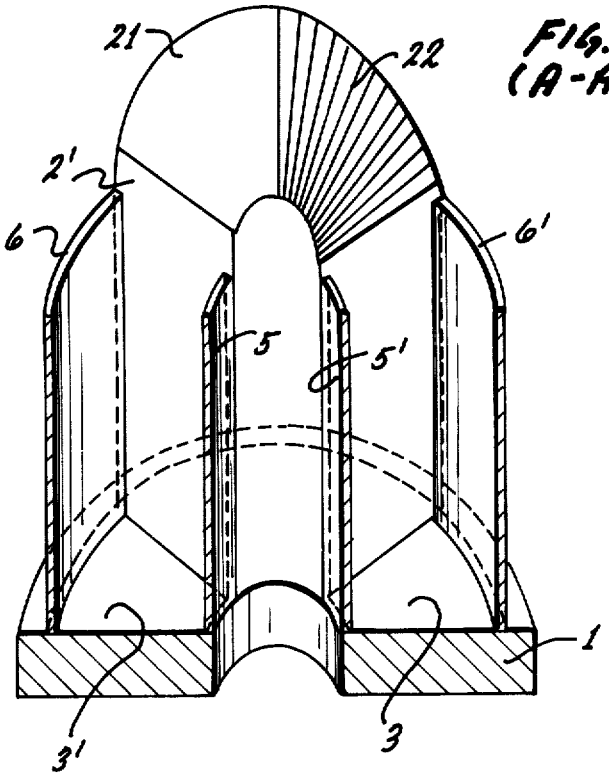
FIG. 3 (A-A)
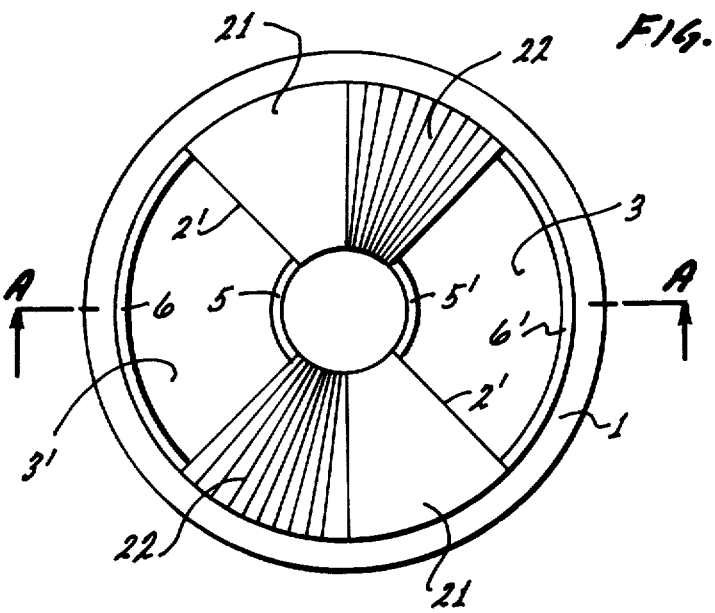
FIG. 4

PRESSING METAL POWDER INTO SHAPES

BACKGROUND OF THE INVENTION

The present invention relates to a method for pressing metal powder to form a consolidated body under utilization of sheet metal, and more particularly, the invention relates to shaping parts, having dimensions which are large in direction of powder pressing as compared with transverse dimensions such as a diameter or a wall thickness of hollow parts, etc.

The art of powder metallurgy is well developed and many parts, such as levers, bushings, bearing parts, etc., are made by filling an appropriate die with powder, and by completing the part through pressing. Subsequently, the part is heat treated (sintered) followed, in cases, by coining or sizing to improve accuracy in the dimensions if such improvement is indeed necessary.

It is also known to press powder into circular or annular blanks, and to forge or extrude these blanks into semi-finished products. In order to protect the blank from dirt and oxidation one usually clads or envelopes the blank into a sheet metal jacket.

Another method of working powder is known to involve powder of spherical particles which are placed into capsules and pre-compacted by means of ultrasonic vibrations to obtain a density of about 60 to 70% of the theoretically obtainable maximum density and to finally compress the particles by isostatic pressure (about 1500 to 5000 bars) to about 80 to 93% of that density. Only upon complying with these conditions, wrinkles will not be produced in the capsule during subsequent extrusion. Such wrinkles result in severe surface defects in the extruded section. The capsule is usually made of a highly ductile material such as nickel.

Isostating compression causes exertion of pressure upon the blank from all directions and in all dimensions. Thus, upon isostatically compressing a circular blank, one reduces its height as well as its diameter. Different powders are compressible to different degrees and differences in density during charging of the die render it rather difficult to obtain a shape whose geometry is sufficiently exact. Such accuracy is needed for the subsequent extrusion.

Other difficulties in powder working relate to particulars of the material. For example, some alloyed steels and other material whose composition is determined by particular purposes of subsequent use, upon being atomized by gas, may yield spherical particles. Such particles are difficult to compact into a state of sufficient coherency and consolidation.

It is further known generally to press metal powder into particular geometric shapes under utilization of steel dies. This widely used method is applicable to powder which flows rather easily into the die cavity and whose particles interlink and/or weld to each other upon being compressed in order to obtain the consolidation. Spherical particles usually flow adequately easily but they do not mechanically link up, and in many cases they weld only at very high pressures. These drawbacks are particularly noticeable when parts are to be made having a length greater than the diameter or greater than the wall's thickness in the case of a hollow. Particularly, one has not yet been able to produce satisfactorily parts under utilization of ball-shaped powder particles, in a steel die or in an isostatic press and without sheet jacket, which part is free from lubricant; geometrically accurate as to its contour; and sufficiently stabile so as to be suitable as a blank in a hot extruder. Spherical particles can be compressed in a hardened steel die and in the absence of a lubricant if the pressure is very high, but the edge strength is usually unsatisfactory for further use. Low pressure fails to compact the powder; the powder particles will flow out of the die upon opening the cavity.

Compressing powder consisting of spherically-shaped particles in a thin, ductile sheet metal jacket by means of an isostatic press, does not yield sufficiently accurate dimensions, needed for further working. Moreover, a thin nickel jacket is difficult to remove, particularly upon extruding. Moreover, a nickel jacket is expensive.

Compressing spherical powder in capsules by means of a plunger and a steel die did also fail to produce satisfactory results for press-forming parts having relatively long dimensions in the direction of punch movement, because the sheet metal capsules were strongly deformed and became wrinkled.

DESCRIPTION OF THE INVENTION

It is an object of the present invention to avoid the drawbacks outlined above and to provide a new and improved method and equipment for pressing metal powder into shapes having, e.g. circular or annular cross-section.

It is another object of the present invention to produce blanks from metal powder to be extruded.

It is a specific object of the present invention to press metal powder into shapes having an axial dimension in the direction of press punch application which is considerably larger than a transverse dimension such as the diameter or a wall thickness of the product being made.

In accordance with the preferred embodiment of the present invention, it is suggested to place a sheet metal container in a press die whose cavity matches the contour of the container and of the desired shape, and to fill the container with metal powder and in steps, with each filling step providing a powder layer or heap of a height less than 1.5, preferably about 0.6 to 0.8 the diameter or wall thickness of the product to be made, and to compress the powder, also in steps, alternating with the filling steps.

A complete layer is not necessarily established by each filling step and in the said transverse dimension, so that the body being made grows also azimuthally in steps.

In the preferred form of practicing the invention, the press punch is provided with one or more axial ducts for feeding powder into the die cavity. This feature permits the press to work with small strokes. One will turn the punch to some extent after each filling. The press working is carried out in a four-cycle fashion; filling, turning, compression, and lifting the punch by a height corresponding to the level of each filling step.

The punch, having on its axial end (inside of the die cavity) one or more outlets for the powder, may have an oblique working surface next to it and a flat working surface next to the latter; any freshly filled powder will thus be precompressed by the oblique surface and completely pressed in the next compression cycle. This method is particularly suitable for pressing hollows.

In each instance, pressing will flatten the sheet metal container against the wall or walls of the die cavity which feature is directly instrumental in obtaining a true to size product being particularly usable as blank for extrusion.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 3 is a perspective view into a section of a modified punch, the section plane being indicated by lines A—A in FIG. 4; and FIG. 4 is an axial view of the press punch as shown in FIG. 3, seen in the direction towards the working surface.

Proceeding now to the detailed description of the drawings, FIGS. 1 and 2 show a die member 9 which is of hollow, blind bore-like configuration but having a center element constructed as a mandrel 10 which has a concentrical position in relation to the cylindrical configuration of die member 9. The closed bottom part of die member 9 rests on roller bearings 11 which, in turn, bear against a base 12.

Figure 1:
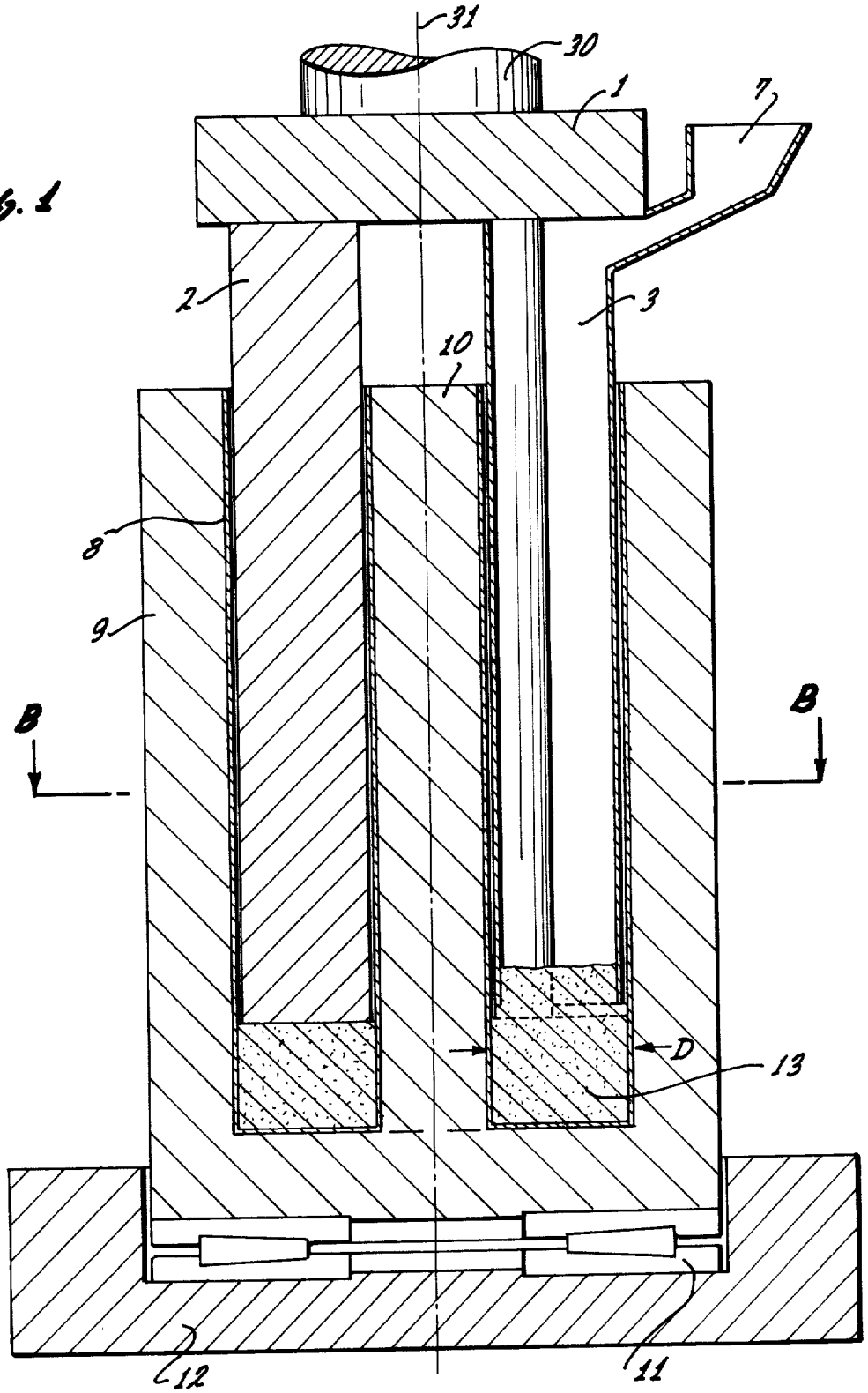
FIG. 1 is a section view through a powder press in accordance with and for practicing the preferred embodiment of the invention.

The annular space between die member 9 and mandrel 10 defines the die cavity. A press punch 2 projects into this cavity, the punch being affixed to a support disk 1 which, in turn, is carried by an operating plunger 30 or the like. Press punch 2 is of tubular configuration, having a duct 3 for the supply of powder. This duct 3 is bounded by radial surfaces 4 of the punch proper by an inside section 5 separating the interior of the recess from the mandrel and by an outside section 6 adjacent to the outer die cavity. A chute or funnel 7 connects the interior of the duct 3 at a location below and laterally offset from disk 1. The duct 3 leads down towards the axial end face of the punch being its operating surface for press work.

A sleeve 8, made of sheet metal and being open at one axial end, has been placed into the die cavity. The sheet has a bottom as well as a lining receiving the mandrel 10. In essence, the sleeve 8 constitutes a sheet metal container which can be deemed a removable lining of the cavity wall including bottom and mandrel 10. After press working the compacted powder will be contained in sleeve 8. Placing the sleeve 8 into the die cavity is the first operating step for pressing powder into an annular shape. Insertion of the sleeve 8, of course, requires removal of the punch.

In accordance with the teaching of the invention, the axial height of the die cavity 6 and of the sleeve 8 is the axial dimension of the product to be made being also the direction of pressing. The annular width D of the die cavity (or of the sleeve 8) is the determinative transverse dimension. After the sleeve 8 is in place, the punch is inserted, its end reaching almost, but not quite, the bottom of sleeve 8. Next, powder 13 is filled into the funnel 7. The powder flows down in duct 3. The punch is lifted slightly and rotated about axis 31 by less than a full turn. The height of the heap thus poured, before or after any flattening on account of turning the lifted punch, is to be less than 1.5 the annular width of the die cavity proper as determined by the inserted sleeve 8. Preferably, the powder height as so deposited is about 0.6 to 0.8 times that annular dimension.

After the operating surface of the press punch 2 or a portion thereof faces the powder, the punch is lowered to compress the powder segment underneath. The amount of powder so treated involves a height much less than the total height of the product to be made, as stated, e.g. about 0.6 to 0.8 times the annular width of the die cavity. Also, only a segment in annular direction, much less than 360° in angular width, is compressed in this one press step. After this press step, the punch is raised and more powder is filled through funnel 7 locating itself next to the compressed portion, whereupon the punch 2 is turned and again a portion is pressed, etc. The product is thus made and grows on a stepwise basis, filling, turning, pressing, lifting, until the sleeve 8 is filled with compressed powder. The blank or body thus made grows gradually with each cycle and compressing step, whereby each new portion is a continuation of the previously made partial, not-yet-completed body or blank. A lid may be pressed on top as the final pressing step. Afterwards, the sleeve-jacketed annulus is taken from the die and used as needed. This blank has exactly the contour given to it by the die.

FIGS. 3 and 4 show a modified press punch. The punch is made from two segments 2' arranged and mounted on the plate 1 in radial symmetry. Semicylindrical members 5,5' and 6,6' join the segments 2' azimuthally and define two diametrically opposed powder feed channels 3 and 3'.

The front ends of the segments 2' are specifically contoured. Each has a surface 21 extending precisely at right angles to the axis of the punch and constitutes a press working face or surface. A surface 22 next to 21 in each instance has an oblique orientation and is provided for precompressing a portion of the powder.

Figure 2:
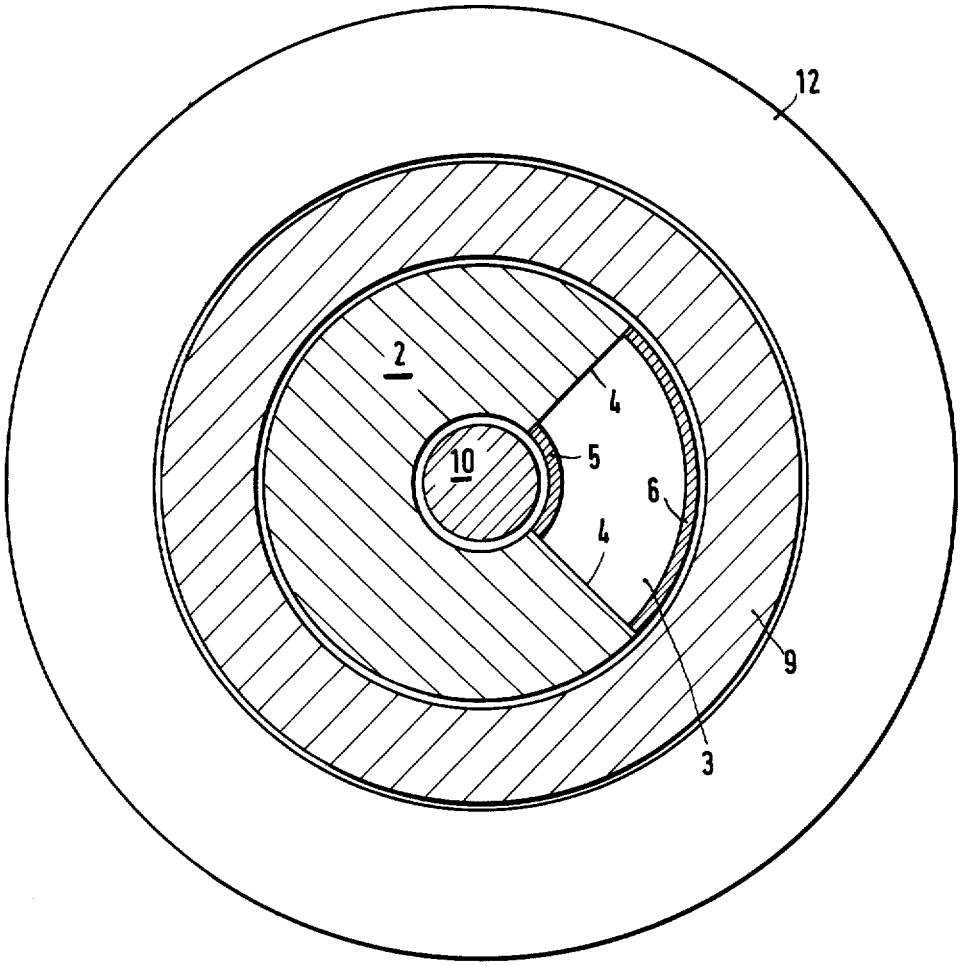
FIG. 2 is a section view taken in a plane as indicated by line B—B in FIG. 1.

Upon filling some powder in the bottom portion of the two channels or ducts 3, 3', the punch is lifted a little and turned by about 30° whereupon a portion of the powder is precompressed by the oblique surfaces 22. The amount of powder to be levelled and precompressed should have a height of less than 1.5 preferably about 0.6 to 0.8 the annular dimension of the die cavity (or of the punch). Some powder will escape azimuthally in the opposite direction and additional powder is fed to the ducts 3 and 3'; after slight lifting and turning again by about 30°, another portion of the powder is precompressed while surfaces 21 provide final compressing of the previously precompressed portions. The precompression, which could also be provided for an oblique punch surface portion as per FIGS. 1 and 2, ensures that the rather fluid powder will not azimuthally escape from under the press surface 21 while being finally compressed. This way, one obtains a more evenly distributed compression.

Again, the press working continues by alternating lifting, filling, turning, and compressing cycles in sequence to stepwise grow the product by compressing limited portions of powder as per each compression step progressing azimuthally as well as axially.

The invention is not limited to the embodiments described above but all changes and modifications thereof not constituting departures from the spirit and scope of the invention are intended to be included.

I claim:

1. A method for pressing metal powder to form a consolidated body having an axial dimension and at least one dimension transverse to that axial dimension, comprising:

(a) Inserting a sheet metal container into a closely fitted die cavity, the container having an open, axial end and internal axial and transverse dimension, corresponding to said dimensions of said body to be formed;

(b) inserting into the said container an axially alligned press punch having an internal duct for pouring said metal powder therethrough;

(c) pouring a mass of that metal powder through said internal duct to partially fill said container to less than a full azimuthal section of that container and to a height along said axial dimension within that container not exeeding about 1.5 times that transverse dimension;

(d) lifting said press punch within said container after the pouring as per step (c);

(e) rotating said press punch about its axial dimension by less than 360° degrees;

(f) moving said press punch downwardly to compress and bond said powder portion into a consolidated mass as an initial portion of said body to be formed;

(g) lifting said press punch from said compressed mass and pouring through said duct an additional mass of said powder, upon and next to said consolidated mass in what amounts to less than a full azimuthal section and also to a height not exceeding 1.5 times that transverse dimension, following which steps (e) and (f) are repeated;

(h) repeating the steps (g), (e), and (f) to cause said formed body to grow azimuthally and in height while bonding each of the masses of added powder thereto until the final size of the body is attained; and (i) removing said container with said final body from said die cavity.

2. The method as in claim 1, wherein said added height is approximately 0.6 to 0.8 times of said transverse dimension.

3. The method as in claim 1 or 2, wherein prior to each step (f) said powder poured as per a step (c) initially, and step (g) subsequently, is precompressed.

* * * * *